US010801791B2

(12) United States Patent
Tanda et al.

(10) Patent No.: US 10,801,791 B2
(45) Date of Patent: Oct. 13, 2020

(54) HEAT EXCHANGER AND REFRIGERATION CYCLE APPARATUS

(71) Applicant: Mitsubishi Electric Corporation, Tokyo (JP)

(72) Inventors: Tsubasa Tanda, Tokyo (JP); Yohei Kato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 134 days.

(21) Appl. No.: 15/572,626

(22) PCT Filed: Jul. 29, 2015

(86) PCT No.: PCT/JP2015/071535
§ 371 (c)(1),
(2) Date: Nov. 8, 2017

(87) PCT Pub. No.: WO2017/017814
PCT Pub. Date: Feb. 2, 2017

(65) Prior Publication Data

US 2018/0135926 A1 May 17, 2018

(51) Int. Cl.
*F28F 1/32* (2006.01)
*F28F 19/00* (2006.01)
(Continued)

(52) U.S. Cl.
CPC ..... *F28F 19/006* (2013.01); *F25B 39/00* (2013.01); *F25B 39/02* (2013.01); *F28D 1/0471* (2013.01);
(Continued)

(58) Field of Classification Search
CPC ..... F28D 1/0478; F28F 17/005; F28F 19/002; F28F 1/32; F28F 1/325
See application file for complete search history.

(56) References Cited

U.S. PATENT DOCUMENTS 6,478,079 B1 * 11/2002 Kato ..... F28F 1/32 165/151
6,662,861 B2 * 12/2003 Ozaki ..... F28D 1/0435 165/135
(Continued)

FOREIGN PATENT DOCUMENTS

JP S54-127451 U1 9/1979
JP S57-35774 Y2 8/1982
(Continued)

OTHER PUBLICATIONS

Extended EP Search Report dated Mar. 6, 2019 issued in corresponding EP patent application No. 15899647.0.
(Continued)

*Primary Examiner* — Filip Zec
(74) *Attorney, Agent, or Firm* — Posz Law Group, PLC

(57) ABSTRACT

Provided is a heat exchanger that is capable of avoiding a bridge phenomenon caused by water droplets between a plurality of flat tubes and is easily manufactured. The heat exchanger includes a plurality of plate-like fins arranged in parallel at intervals, the plurality of flat tubes inserted into the plurality of plate-like fins, and at least one water-guiding member arranged between adjacent ones of the plurality of flat tubes projecting from at least one of both outermost ones of the plurality of plate-like fins and having both end portions held in contact with projecting flat surfaces of the adjacent ones of the plurality of flat tubes.

9 Claims, 6 Drawing Sheets

(51) Int. Cl.

| | |
|---|---|
| ***F25B 39/02*** | (2006.01) |
| ***F28D 1/047*** | (2006.01) |
| ***F28F 17/00*** | (2006.01) |
| ***F25B 39/00*** | (2006.01) |
| *F28D 21/00* | (2006.01) |

(52) U.S. Cl.

CPC ..... *F28D 1/0478* (2013.01); *F28F 1/32* (2013.01); *F28F 1/325* (2013.01); *F28F 17/005* (2013.01); *F28F 19/002* (2013.01); *F25B 2500/06* (2013.01); *F28D 1/0476* (2013.01); *F28D 2021/0068* (2013.01); *F28F 2265/14* (2013.01)

(56) References Cited

U.S. PATENT DOCUMENTS

| | | | | |
|---|---|---|---|---|
| 2005/0217834 | A1* | 10/2005 | Valensa | F28D 1/0478 165/150 |
| 2008/0202153 | A1* | 8/2008 | Watanabe | F25B 39/022 62/498 |
| 2012/0024509 | A1 | 2/2012 | Ueno | |
| 2012/0272677 | A1 | 11/2012 | Furumaki et al. | |
| 2013/0087315 | A1 | 4/2013 | Hamaguchi | |
| 2016/0054038 | A1 | 2/2016 | Matsui et al. | |

FOREIGN PATENT DOCUMENTS

| | | | | | |
|---|---|---|---|---|---|
| JP | S62-012426 | U1 | | 1/1987 | |
| JP | 03181759 | A | * | 8/1991 | F28F 17/005 |
| JP | H10-62085 | A | | 3/1998 | |
| JP | 11101594 | A | * | 4/1999 | F28F 17/005 |
| JP | 2009-085467 | A | | 4/2009 | |
| JP | 2010-203726 | A | | 9/2010 | |
| JP | 2010-249498 | A | | 11/2010 | |
| JP | 2010-255885 | A | | 11/2010 | |
| JP | 2011-202820 | A | | 10/2011 | |
| JP | 2012-037092 | A | | 2/2012 | |
| WO | 2012/011331 | A1 | | 1/2012 | |
| WO | 2014/181400 | A1 | | 11/2014 | |

OTHER PUBLICATIONS

Office action dated Jun. 19, 2018 issued in corresponding JP patent application No. 2017-530544 (and English translation thereof).

International Search Report of the International Searching Authority dated Oct. 20, 2015 for the corresponding international application No. PCT/JP2015/071535 (and English translation).

Office Action dated Jul. 29, 2019 issued in corresponding CN patent application No. 201580081822.X (and English machine translation).

* cited by examiner

HEAT EXCHANGER AND REFRIGERATION CYCLE APPARATUS

CROSS REFERENCE TO RELATED APPLICATION

This application is a U.S. national stage application of International Application No. PCT/JP2015/071535, filed on Jul. 29, 2015, the contents of which are incorporated herein by reference.

TECHNICAL FIELD

The present invention relates to a heat exchanger of a fin-and-tube type including flat tubes, and to a refrigeration cycle apparatus including the heat exchanger.

BACKGROUND

As a related-art fin-and-tube heat exchanger, there has been known a heat exchanger as disclosed in, for example, Patent Literature 1, in which water-guiding pieces formed by lugging a side plate are provided to remove water droplets generated on coupling tubes for heat transfer tubes.

PATENT LITERATURE

Patent Literature 1: Japanese Unexamined Patent Application Publication No. Hei 10-62085

However, in the structure of Patent Literature 1, a bridge of water droplets may be formed between the heat transfer tube and the water-guiding piece, and the bridge of water droplets may be frozen to form ice pieces. In particular, when flat tubes are used as the heat transfer tubes of Patent Literature 1, water is liable to stagnate on flat surfaces of the flat tubes due to the surface tension, with the result that a possibility of causing the formation of the bridge of the water droplets is increased. Consequently, in the structure of Patent Literature 1, there is a risk in that the heat transfer tubes are damaged due to the ice pieces thus formed, and hence there has been a problem in that the safety of a refrigeration cycle apparatus cannot be ensured. Further, in the structure of Patent Literature 1, the water-guiding pieces are formed by lugging the side plate, and hence there has been a problem in that a manufacturing method is complicated.

SUMMARY

The present invention has been made to solve the above-mentioned problems and has an object to provide a heat exchanger that is capable of avoiding a bridge phenomenon caused by water droplets between flat tubes and is easily manufactured, and a refrigeration cycle apparatus including the heat exchanger.

According to one embodiment of the present invention, there is provided a heat exchanger, including a plurality of plate-like fins arranged in parallel at intervals, a plurality of flat tubes inserted into the plurality of plate-like fins, and at least one water-guiding member arranged between adjacent ones of the plurality of flat tubes projecting from at least one of both outermost ones of the plurality of plate-like fins and having both end portions held in contact with projecting flat surfaces of the adjacent ones of the plurality of flat tubes.

Further, according to one embodiment of the present invention, there is provided a refrigeration cycle apparatus including the above-mentioned heat exchanger.

According to one embodiment of the present invention, the water-guiding members are arranged between the projecting flat tubes to be held in contact with the flat surfaces of the flat tubes. Consequently, there can be provided the heat exchanger that is capable of avoiding the bridge phenomenon caused by water droplets between the flat tubes and is easily manufactured, and the refrigeration cycle apparatus including the heat exchanger.

DETAILED DESCRIPTION

Embodiment 1

Figure 1:
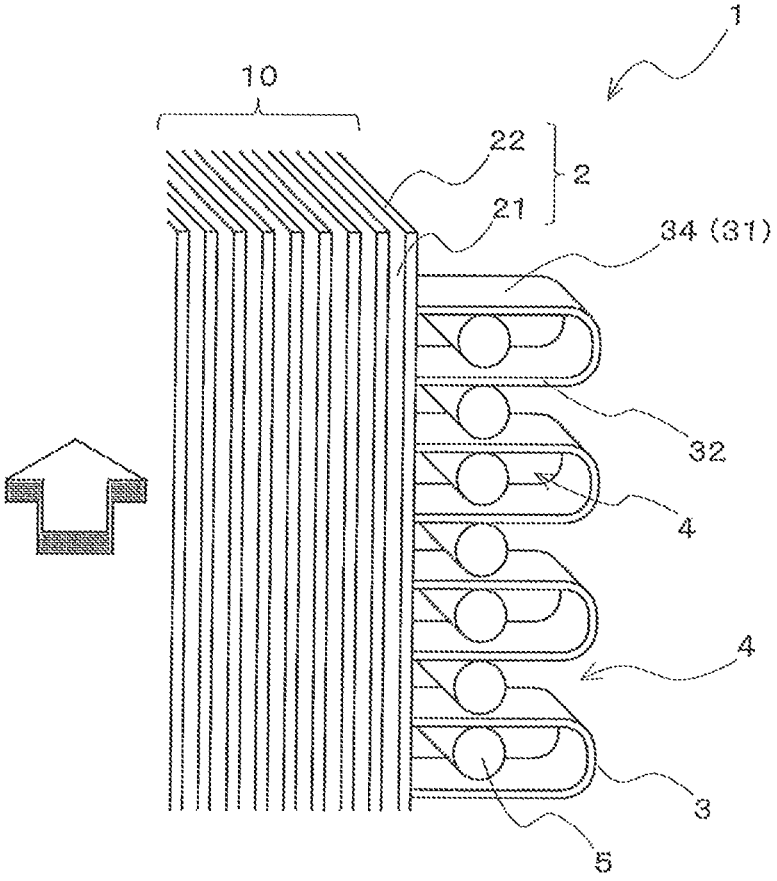
FIG. 1 is a perspective view for schematically illustrating a part of the structure of a heat exchanger 1 according to Embodiment 1 of the present invention.

The structure of a heat exchanger 1 according to Embodiment 1 of the present invention is described. FIG. 1 is a perspective view for schematically illustrating a part of the structure of the heat exchanger 1 according to Embodiment 1. The outline block arrow in FIG. 1 indicates a flow direction of air flowing in a direction from the front surface to the rear surface of the drawing sheet. As illustrated in FIG. 1, the heat exchanger 1 according to Embodiment 1 is a fin-and-tube heat exchanger including a plurality of plate-like fins 2 and a plurality of flat tubes 3. The plurality of flat tubes 3 cross the plurality of plate-like fins 2, and each have a flat cross-sectional shape. The heat exchanger 1 is configured to exchange heat between air flowing along the plurality of plate-like fins 2 and refrigerant flowing through the plurality of flat tubes 3.

In the drawings including FIG. 1 referred to below, a dimensional relationship of components and shapes of the components may be different from those of actual components. Further, in the drawings referred to below, the same or similar components and parts are denoted by the same reference signs, or the reference signs of the components and the parts are omitted. Further, a positional relationship, for example, a relationship of positions of the components in an up-and-down direction in the following description is basically defined in a case where the heat exchanger 1 according to each of embodiments including Embodiment 1 described below is installed in a usable state.

The plate-like fins 2 each include a pair of plate surfaces 21 and a peripheral edge portion 22 located between sides of the pair of plate surfaces 21. In the heat exchanger 1, the plurality of plate-like fins 2 are arranged such that the pairs of plate surfaces 21 are arranged in parallel at intervals. The plurality of plate-like fins 2 arranged in parallel serve as a heat exchange part 10 configured to allow air to flow along the plate surfaces 21 and exchange heat with the refrigerant flowing through flat tubes 3. Further, although not illustrated, a heat-transfer promoting portion having peak portions and trough portions alternately arrayed may be formed on each of the plate surfaces 21 of each of the plate-like fins 2. In such a case, heat transfer in the plate-like fins 2 can be promoted.

Figure 6:
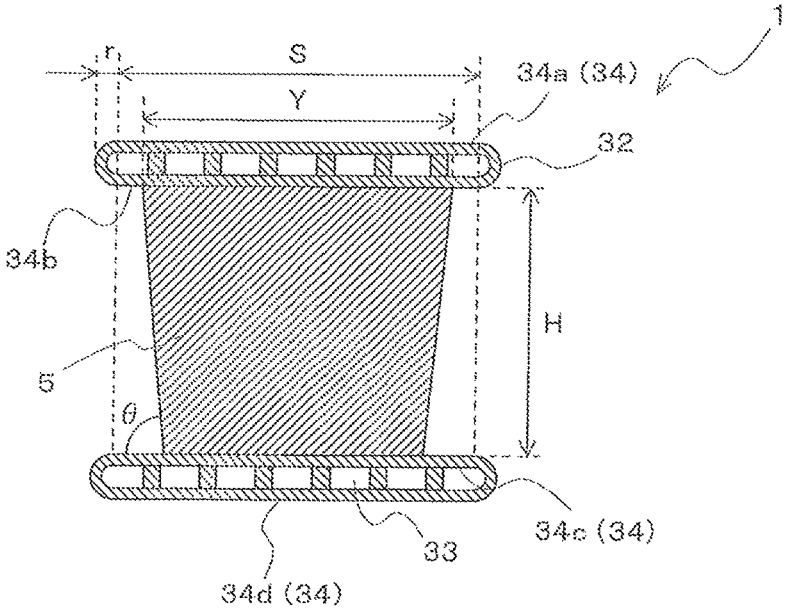
FIG. 6 is a schematic cross-sectional view taken along the line X-X of FIG. 5 and viewed in the arrow direction.

The flat tubes 3 each include a pair of flat surfaces 31, a pair of bent surfaces 32 having a semicircular shape in tube cross section, and one or more refrigerant flow passages 33. The one or more refrigerant flow passages 33 are located between the pair of flat surfaces 31, that is, inside the flat tube 3, and extend in a longitudinal direction of the pair of flat surfaces 31. The one or more refrigerant flow passages 33 are not illustrated in FIG. 1, but are illustrated in FIG. 6 referred to below, and hence it is suggested to see FIG. 6. In the heat exchanger 1, the plurality of flat tubes 3 are arranged such that the pairs of flat surfaces 31 are arranged in parallel at intervals. The flat tubes 3 are, for example, press-fitted in a direction orthogonal to the plate surfaces 21 and the peripheral edge portions 22 of the plurality of plate-like fins 2 to cross the plurality of plate-like fins 2. In FIG. 1, the flat tubes 3 each having a U-shape obtained by bending the flat tubes 3 each into a hair-pin shape, are exemplified. Through use of refrigerant tubes each having a U-shape as the flat tubes 3, the flat tubes 3 can each be stretched over a stacking direction, for example, in FIG. 1, over an up-and-down direction.

The flat tubes 3 each include a plurality of projecting flat surfaces 34 opposed to each other through an air gap 4. The plurality of projecting flat surfaces 34 are obtained by causing at least one side of longitudinal end portions of the pair of flat surfaces 31 to project outward from at least one side of the heat exchange part 10, that is, at least one of both outermost ones of the plate-like fins 2. That is, the plurality of projecting flat surfaces 34 are a part of the flat surfaces 31.

The heat exchanger 1 according to Embodiment 1 includes a plurality of water-guiding members 5 arranged in the air gaps 4 each between the projecting flat surfaces 34. Both end portions of each of the plurality of water-guiding members (or water guide) 5 are held in contact with the projecting flat surfaces 34 on sides close to the projecting flat surfaces 34. In FIG. 1, there are exemplified the water-guiding members (or water guide) 5 each having a cylindrical shape, in which upper and lower end portions of the cylindrical surface are held in contact with the projecting flat surfaces 34. In the following, arrangement of the water-guiding members 5 each having a cylindrical shape illustrated in FIG. 1 is described with reference to FIG. 2.

Figure 2:
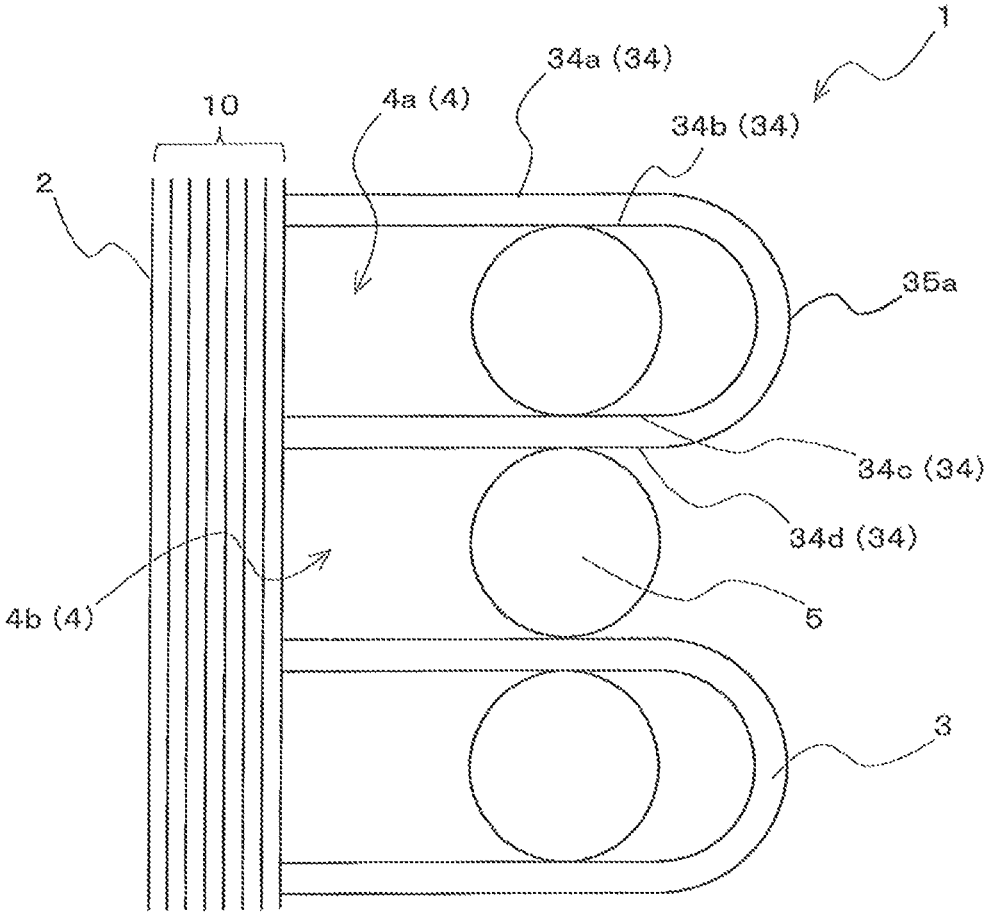
FIG. 2 is an illustration of an example of a schematic front view of a part of the structure of the heat exchanger 1 according to Embodiment 1 of the present invention as viewed from a windward side of a flow direction of air.

FIG. 2 is an illustration of an example of a schematic front view of a part of the structure of the heat exchanger 1 according to Embodiment 1 as viewed from a windward side of the flow direction of air. In FIG. 2, similarly to FIG. 1, the heat exchanger 1 including the flat tubes 3 each having a U-shape is exemplified. The projecting flat surfaces 34 of the flat tube 3 having a U-shape include a first projecting flat surface 34*a* located on an upper outer side, a second projecting flat surface 34*b* located on an upper inner side, a third projecting flat surface 34*c* located on a lower inner side, and a fourth projecting flat surface 34*d* located on a lower outer side.

In FIG. 2, the water-guiding members 5 each having a cylindrical shape illustrated in an uppermost portion and an lowermost portion are arranged in first air gaps 4*a* each between the second projecting flat surface 34*b* and the third projecting flat surface 34*c* such that the cylindrical surfaces of the water-guiding members 5 each having a cylindrical shape are each held in contact with the second projecting flat surface 34*b* and the third projecting flat surface 34*c*. Further, the water-guiding member 5 having a cylindrical shape illustrated in an intermediate portion is arranged in a second air gap 4*b* between the fourth projecting flat surface 34*d* and the first projecting flat surface 34*a* such that the cylindrical surface of the water-guiding member 5 having a cylindrical shape is held in contact with the fourth projecting flat surface 34*d* and the first projecting flat surface 34*a*. The first air gaps 4*a* and the second air gap 4*b* in FIG. 2 are examples of the air gaps 4 illustrated in FIG. 1.

In FIG. 2, the refrigerant tubes each having a U-shape are exemplified as an example of the flat tubes 3. However, for example, refrigerant tubes each having a straight shape may be used. The heat exchanger 1 may have a configuration in which the refrigerant tubes each having a straight shape are used as the flat tubes 3, and the water-guiding members 5 are arranged between the projecting flat surfaces 34 of the flat tubes 3. The configuration of the heat exchanger 1 in the case where the refrigerant tubes each having a straight shape are used as the flat tubes 3 is illustrated in FIG. 3.

Figure 3:
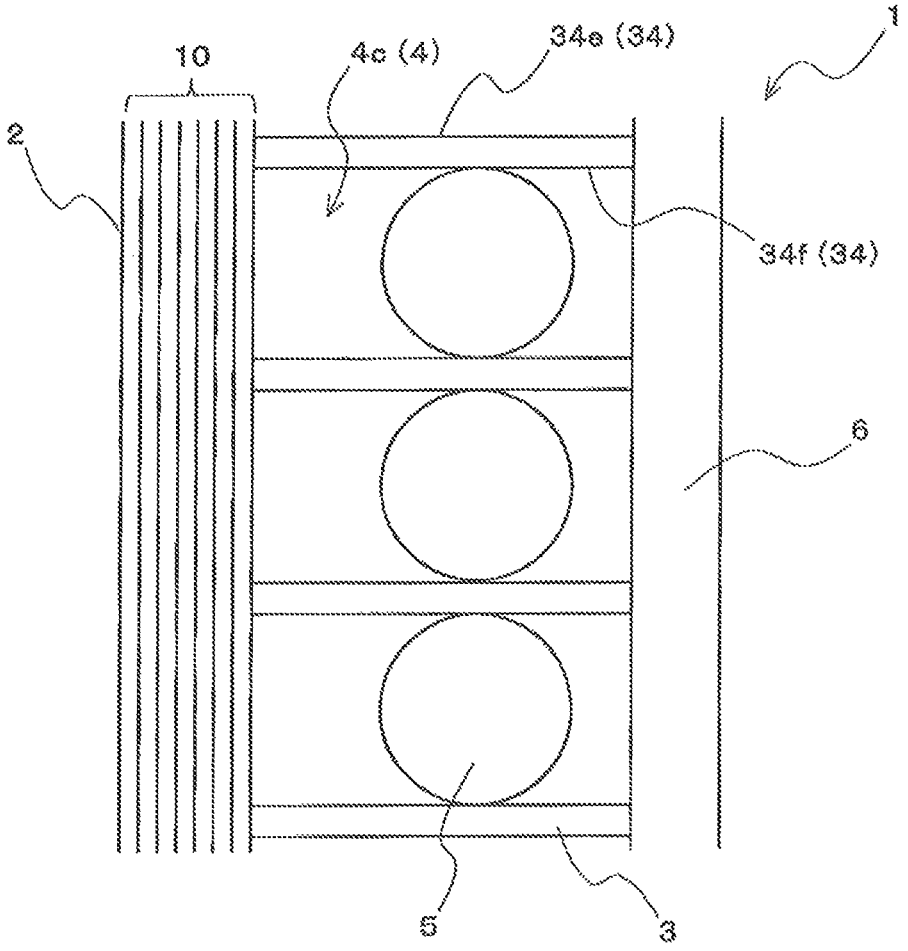
FIG. 3 is an illustration of another example of a schematic front view of a part of the structure of the heat exchanger 1 according to Embodiment 1 of the present invention as viewed from the windward side of the flow direction of air.

FIG. 3 is an illustration of another example of a schematic front view of a part of the structure of the heat exchanger 1 according to Embodiment 1 as viewed from the windward side of the flow direction of air. In FIG. 3, end portions of the flat tubes 3 are joined to a header pipe 6. The projecting flat surfaces 34 of the flat tube 3 include a fifth projecting flat surface 34*e* located on an upper side, and a sixth projecting flat surface 34*f* located on a lower side.

Also in the heat exchanger 1 in FIG. 3, the water-guiding members 5 each having a cylindrical shape can each be arranged in a third air gap 4*c* between the fifth projecting flat surface 34*e* and the sixth projecting flat surface 34*f* such that the cylindrical surfaces of the water-guiding members 5 each having a cylindrical shape are each held in contact with the fifth projecting flat surface 34*e* and the sixth projecting flat surface 34*f*. The third air gap 4*c* in FIG. 3 is an example of the air gap 4 illustrated in FIG. 1.

The water-guiding member 5 only needs to have such a shape that the both end portions of the water-guiding member 5 on the sides close to the projecting flat surfaces 34 are held in contact with the projecting flat surfaces 34. For example, the water-guiding member 5 can have a spherical shape, a cylindrical shape, a polygonal columnar shape, or a polyhedral shape. The water-guiding member 5 has such a shape as to be held in contact with the projecting flat surfaces 34 at both the end portions of the water-guiding member 5 on the side of the projecting flat surfaces 34. Thus, formation of a bridge of water droplets between the projecting flat surfaces 34 can be avoided, and the drainage performance can be enhanced accordingly.

Further, as a material of the water-guiding member 5, there may be used a metal material having high heat conductivity, such as aluminum and aluminum alloy, or a resin material such as plastic. In a case where a metal material is used for the water-guiding member 5, to prevent corrosion due to contact between metals of different kinds, namely, galvanic corrosion, as the metal material of the water-guiding member 5, there is used the same metal material as the material of the flat tube 3 or a metal material selected from metal materials having a small potential difference from the material of the flat tube 3.

The coupling portions between the plate-like fins 2 and the flat tubes 3 and the contact portions between the flat tubes 3 and the water-guiding members 5 are joined to each other by, for example, brazing. For example, in a case where the material of the flat tube 3 is aluminum, the water-guiding member 5 is formed by using a clad material of aluminum, and the flat tubes 3 and the water-guiding members 5 are integrated by brazing, and the drainage performance can be enhanced accordingly. Methods other than brazing may be used as the method of joining the coupling portions and the contact portions as long as the heat conductivity at the coupling portions and the contact portions can be maintained. For example, the coupling portions and the contact portions may be joined by welding or bonding.

Figure 4:
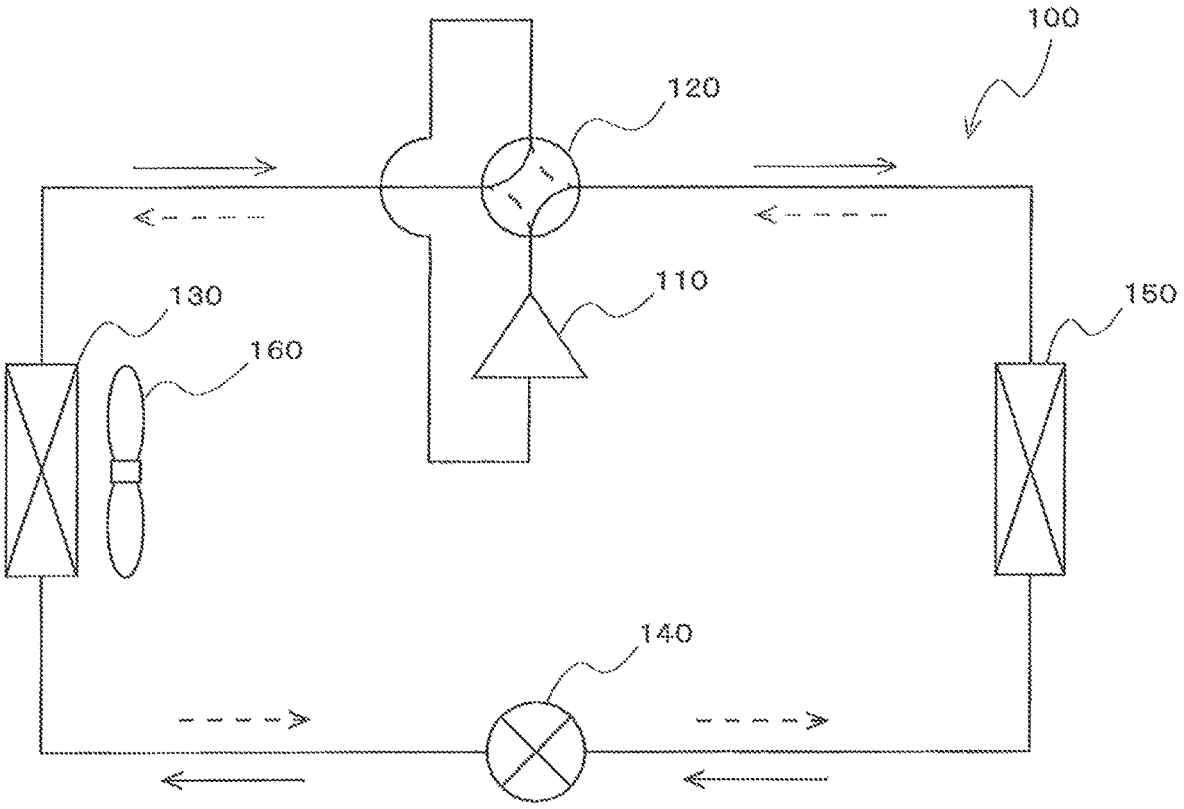
FIG. 4 is a refrigerant circuit diagram for schematically illustrating an example of an air-conditioning apparatus 100 according to Embodiment 1 of the present invention.

Next, a refrigeration cycle apparatus including the heat exchanger 1 according to Embodiment 1 is described with reference to FIG. 4. FIG. 4 is a refrigerant circuit diagram for schematically illustrating the refrigeration cycle apparatus according to Embodiment 1, that is, an air-conditioning apparatus 100 shown as an example of a heat pump apparatus.

As illustrated in FIG. 4, the air-conditioning apparatus 100 has a configuration including a compressor 110, a refrigerant flow switching device 120, a heat source-side heat exchanger 130, a pressure reducing device 140, and a load-side heat exchanger 150, which are annularly connected to each other by refrigerant pipes. The heat exchanger 1 according to Embodiment 1 is used as at least one of the heat source-side heat exchanger 130 or the load-side heat exchanger 150. In the followings, a case where the heat exchanger 1 is used as the heat source-side heat exchanger 130 is described. Further, the air-conditioning apparatus 100 includes a heat source-side air-sending fan 160 configured to send outdoor air to the heat source-side heat exchanger 130.

In FIG. 4, only minimum necessary components of the air-conditioning apparatus 100 configured to perform both a cooling operation and a heating operation are illustrated. The air-conditioning apparatus 100 may include a gas-liquid separator, a receiver, an accumulator, and other related component in addition to the components illustrated in FIG. 4. Further, in a case where the air-conditioning apparatus 100 is dedicated to cooling or heating, the refrigerant flow switching device 120 may be omitted.

The compressor 110 is a fluid machine configured to compress sucked low pressure refrigerant and discharge the refrigerant as high pressure refrigerant.

The refrigerant flow switching device 120 is configured to switch a direction of a flow of refrigerant in the refrigeration cycle for the cooling operation and the heating operation. For example, a four-way valve is used as the refrigerant flow switching device 120.

The heat source-side heat exchanger 130 is a heat exchanger that acts as an evaporator during the heating operation and acts as a condenser during the cooling operation. In the heat source-side heat exchanger 130, heat is exchanged between refrigerant flowing through the heat source-side heat exchanger 130 and outdoor air sent by the heat source-side air-sending fan 160. In the air-conditioning apparatus 100, the evaporator may be referred to as a cooler, and the condenser may be referred to as a radiator.

The pressure reducing device 140 is configured to decompress high pressure refrigerant into low pressure refrigerant. As the pressure reducing device 140, for example, a linear electronic expansion valve (LEV) adjustable in opening degree is used.

The load-side heat exchanger 150 is a heat exchanger that acts as a condenser during the heating operation and acts as an evaporator during the cooling operation. In the load-side heat exchanger 150, for example, heat is exchanged between indoor air and refrigerant flowing through the load-side heat exchanger 150. Although not illustrated in FIG. 4, the indoor air is sent to the load-side heat exchanger 150 by, for example, a load-side air-sending fan.

In this case, "the heating operation" refers to an operation of feeding high-temperature and high-pressure refrigerant to the load-side heat exchanger 150, and "the cooling operation" refers to an operation of feeding low-temperature and low-pressure refrigerant to the load-side heat exchanger 150. In FIG. 4, a flow of refrigerant during the heating operation is indicated by the solid-line arrows, and a flow of refrigerant during the cooling operation is indicated by the broken-line arrows.

Figure 5:
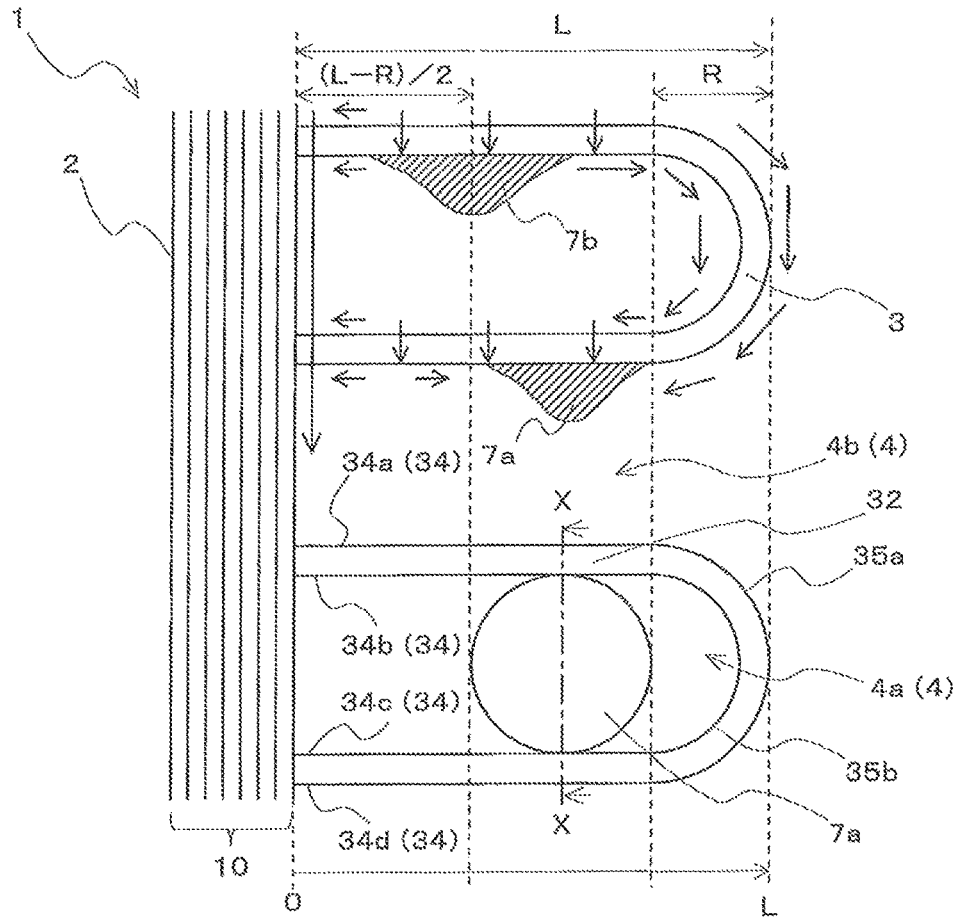
FIG. 5 is a schematic view for illustrating an example of a drainage operation in the heat exchanger 1 according to Embodiment 1 of the present invention.

Next, a drainage operation of the heat exchanger 1 during the heating operation in a case where the heat exchanger 1 according to Embodiment 1 is used as the heat source-side heat exchanger 130 in the air-conditioning apparatus 100 according to Embodiment 1 is described with reference to FIG. 5. FIG. 5 is a schematic view for illustrating an example of the drainage operation in the heat exchanger 1 according to Embodiment 1.

In the air-conditioning apparatus 100, when the heating operation is continued for a long period of time, dew condensation water, that is, condensed water is generated on a surface of the heat source-side heat exchanger 130 that acts as the evaporator, that is, the heat exchanger 1. In the heat exchange part 10 of the heat exchanger 1, the condensed water is drained due to the gravity through the plate-like fins 2 serving as water-guiding passages.

Meanwhile, in a case where the projecting flat surfaces 34 of the flat tubes 3 are exposed to outside air, when the outside air is cooled down to a dew-point temperature, water droplets of condensed water are also generated on the projecting flat surfaces 34 of the flat tubes 3. The projecting flat surfaces 34 are located on an outer side of the heat exchange part 10, that is, the outer side of the plate-like fins 2 arranged on both the ends. Thus, the water droplets generated on the projecting flat surfaces 34 may not be drained through the plate-like fins 2 serving as the water-guiding passages. In FIG. 5, the heat exchanger 1 including the two flat tubes 3 each having a U-shape is illustrated. However, in the followings, using the flat tube 3 on the upper side on the drawing sheet, a drainage operation for condensed water in a case where the water-guiding member 5 is not arranged in the first air gap 4*a* is described as a comparative example. The arrows in the flat tube 3 on the upper side on the drawing sheet of FIG. 5 indicate flows of water droplets.

Water droplets of condensed water generated on the first projecting flat surface 34*a* are drained due to the gravity through the plate-like fins 2 serving as the water-guiding passages in a case where the water droplets of condensed water are generated close to the heat exchange part 10. Further, in a case where water droplets are generated close to the bent surface 32, the water droplets flow along the bent surface 32 due to the gravity to reach the second projecting flat surface 34*b*. Meanwhile, water droplets generated close to a first arc surface 35*a* serving as an outer arc surface of the flat tube 3 having a U-shape flow along the first arc surface 35*a* due to the gravity to reach the fourth projecting flat surface 34*d*. No drainage passage is provided in a part of the fourth projecting flat surface 34*d* located on the side of the first arc surface 35*a*. Consequently, due to the surface tension of water droplets, a stagnation part 7*a* of the condensed water is liable to be generated.

Further, water droplets of condensed water generated on the second projecting flat surface 34*b* are drained due to the gravity through the plate-like fins 2 serving as the water-guiding passages in the case where the water droplets of condensed water are generated close to the heat exchange part 10. Further, water droplets generated close to a second arc surface 35*b*, which is an inner arc surface of the flat tube 3 having a U-shape, flow along the second arc surface 35*b* due to the gravity to reach the third projecting flat surface 34*c*. Meanwhile, water droplets generated between the heat exchange part 10 and the raised position of the second arc surface 35*b* are not drained through any of the plate-like fins 2 and the second arc surface 35*b*. Consequently, a stagnation part 7*b* of the condensed water is liable to be generated due to the surface tension of the water droplets. Consequently, in the case where the heat exchanger 1 includes no water-guiding member 5, part of the condensed water stagnates on the projecting flat surface 34 due to the surface tension of the water droplets or other causes.

Consequently, the water-guiding member 5 is arranged in a direction away from a center position of the projecting flat surface 34 and the heat exchange part 10, that is, the plate-like fins 2, in a projecting direction of the flat tube 3, that is, in a longitudinal direction of the projecting flat surface 34. With this configuration, the drainage of the condensed water can be promoted. For example, the crossing portion between the heat exchange part 10 and the projecting flat surfaces 34 in the longitudinal direction of the projecting flat surface 34 is defined as a reference point 0. A length of the projecting portion of the flat tube 3 is defined as L, and a radius of the first arc surface 35*a* is defined as R. A center position of the water-guiding member 5 in the longitudinal direction of the projecting flat surface 34 is defined as X. In this case, the water-guiding member 5 is arranged such that the center position X of the water-guiding member 5 satisfies Expression (1). With this configuration, the stagnation of the condensed water can be avoided to promote the drainage of the condensed water.

$$(L-R)/2<x<L \quad (1)$$

In Embodiment 1, even when the projecting flat surfaces 34 are exposed to outside air at 0 degrees Celsius or less or refrigerant at 0 degrees Celsius or less is present inside the flat tube 3, the drainage is promoted by the water-guiding member 5. Thus, formation of ice pieces from the condensed water can be avoided.

Consequently, a risk of causing breakage of the flat tube 3 and leakage of a fluid in the flat tube 3 to the outside due to the formation of ice pieces from the condensed water can be avoided. Further, through the promotion of the drainage of the condensed water, the frequency of an operation for defrosting can be reduced, and the amount of energy consumption of the air-conditioning apparatus 100 as a whole can be reduced accordingly.

Next, a drainage operation for water droplets flowing from the first projecting flat surface 34*a* or the third projecting flat surface 34*c* along the bent surface 32 to reach the second projecting flat surface 34*b* or the fourth projecting flat surface 34*d* is described with reference to FIG. 6. FIG. 6 is a schematic cross-sectional view taken along the line X-X of FIG. 5 and viewed in the arrow direction. In FIG. 6, a cross-sectional width of the projecting flat surface 34 in a transverse direction of the projecting flat surface 34 is defined as S, and a radius of the bent surface 32 is defined as r. Further, an angle formed between a straight portion of a cross section of the third projecting flat surface 34*c* and a straight portion of a cross section of the water-guiding member 5*a* connecting a contact point between the water-guiding member 5 and the second projecting flat surface 34*b* and a contact point between the water-guiding member 5 and the third projecting flat surface 34*c* is defined as θ.

In FIG. 6, consideration is made on the drainage operation for water droplets flowing from the first projecting flat surface 34*a* along the bent surface 32 to reach the second projecting flat surface 34*b*. The water droplets having reached the second projecting flat surface 34*b* are drained more rapidly as a distance to which the water droplets come into contact with the water-guiding member 5 is shorter. Consequently, in a case where a cross-sectional width of the contact portion of the water-guiding member 5 in the transverse direction of the second projecting flat surface 34*b* is defined as Y, the cross-sectional width Y of the contact portion of the water-guiding member 5 is set to be equal to the cross-sectional width S of the projecting flat surface 34. With this configuration, the drainage of the condensed water can be promoted. Further, a width H of the water-guiding member 5 in a pitch-width direction of the flat tubes 3 is set to be equal to a width between the second projecting flat surface 34*b* and the third projecting flat surface 34*c*. Further, the angle θ is set to 90 degrees. With this configuration, the condensed water rapidly flows along the bent surface 32 to reach the fourth projecting flat surface 34*d*. Thus, the drainage of the condensed water can be promoted. That is, when the cross section of the water-guiding member 5 is formed into a rectangular shape, and the cross-sectional width Y of the contact portion of the water-guiding member 5 is set to be equal to the cross-sectional width S of the projecting flat surface 34, the drainage of the condensed water can further be promoted.

As described above, the heat exchanger 1 according to Embodiment 1 includes the plurality of plate-like fins 2 arranged in parallel at intervals, the plurality of flat tubes 3 inserted into the plate-like fins 2, and the water-guiding members 5 each arranged between adjacent ones of the flat tubes 3 projecting from at least one of the plurality of plate-like fins 2 arranged on both the ends and having both end portions held in contact with the flat surfaces 31 of the adjacent ones of the flat tubes 3.

Further, the air-conditioning apparatus 100 according to Embodiment 1 includes the above-mentioned heat exchanger 1.

With this configuration according to Embodiment 1, the water-guiding members 5 are arranged between the flat tubes 3 to be held in contact with the projecting flat surfaces 34. Thus, the bridge phenomenon caused by the water droplets between the projecting flat surfaces 34 can be avoided, with the result that the drainage of the water droplets adhering on the projecting flat surfaces 34 is promoted. Further, the plurality of water-guiding members 5 are arranged between the projecting flat tubes 3, and hence the manufacturing method is simple. Consequently, with this configuration according to Embodiment 1, there can be provided the heat exchanger 1 that is capable of avoiding the bridge phenomenon caused by the water droplets and is easily manufactured, and the air-conditioning apparatus 100.

Further, in the heat exchanger 1 according to Embodiment 1, the projecting portions of the flat tubes 3 are each bent into a U-shape. The refrigerant tubes each having a U-shape are used as the flat tubes 3. Thus, a header portion joined to terminal ends of the refrigerant tubes each having a U-shape can be arranged in the same direction, with the result that the downsizing of the heat exchanger 1 can be achieved.

Further, in the heat exchanger 1 according to Embodiment 1, the water-guiding members 5 can each be arranged in the direction away from the center position of the projecting flat surface 34 and the plate-like fins 2, in the longitudinal direction of the projecting flat surface 34. Further, the cross-sectional width of the contact portion of the water-guiding member 5 in the transverse direction of the projecting flat surface 34 can be set to be equal to the cross-sectional width of the projecting flat surface 34 in the transverse direction. With this configuration, the drainage of the condensed water can further be promoted.

Further, in the heat exchanger 1 according to Embodiment 1, the water-guiding members 5 can be formed by members each having a cylindrical shape, a polygonal columnar shape, or a polyhedral shape. Further, the water-guiding members 5 may be formed by members each having a spherical shape. Further, the water-guiding members 5 can be formed by members made of the same material as those of the flat tubes 3 or by members made of a resin. The water-guiding members 5 can be formed by various materials into various shapes. Thus, the manufacture can be simplified.

Embodiment 2

Figure 7:
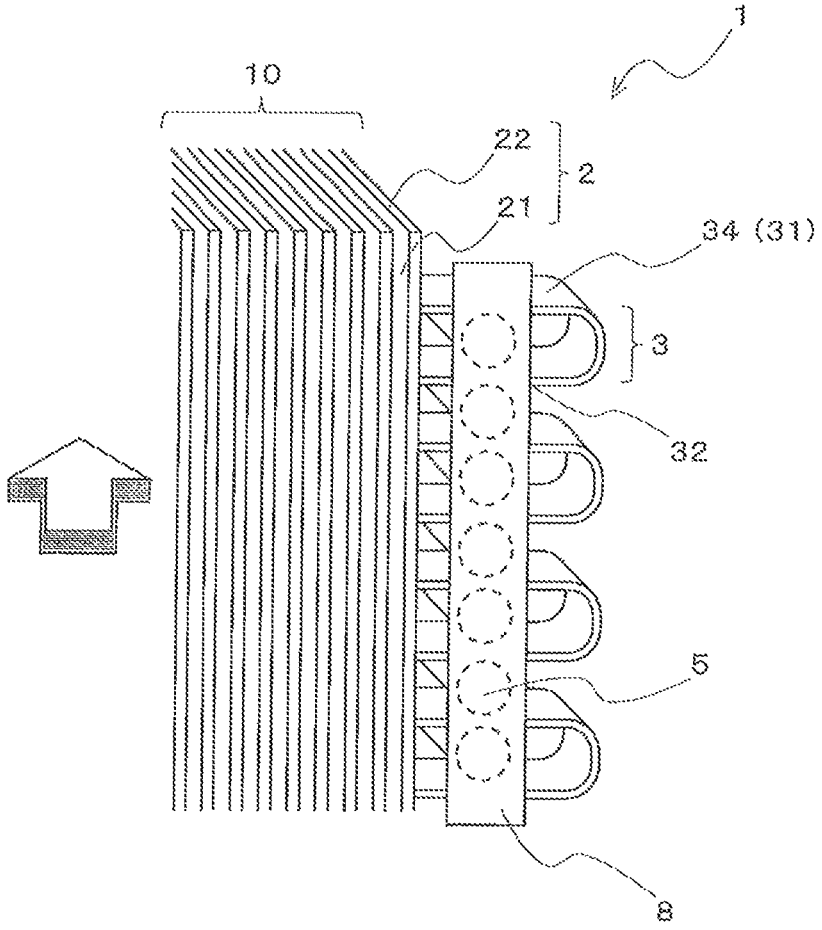
FIG. 7 is a perspective view for schematically illustrating a part of the structure of a heat exchanger 1 according to Embodiment 2 of the present invention.

The structure of a heat exchanger 1 according to Embodiment 2 of the present invention is described. FIG. 7 is a perspective view for schematically illustrating a part of the structure of the heat exchanger 1 according to Embodiment 2. The heat exchanger 1 according to Embodiment 2 is a modification example of the above-mentioned heat exchanger 1 according to Embodiment 1.

In the heat exchanger 1 according to Embodiment 2, each of the water-guiding members (or water guides) 5 is fixed to a support member (or supporter) 8. Other structures of the heat exchanger 1 are similar to those of the above-mentioned heat exchanger 1 according to Embodiment 1, and hence description of the other structures is omitted.

The support member 8 is only required to to be able to fix the water-guiding members 5. For example, the support member 8 can be formed by a plate-like member having a rectangular shape. Further, the support member 8 can be formed by a member made of the same material as those of the water-guiding members 5 or by a member made of a resin. Further, the support member 8 may be increased in width in the longitudinal direction of the projecting flat surfaces 34 to be used as a windshield member.

In Embodiment 2, all of the water-guiding members 5 can be mounted to the heat exchanger 1 at a time by fixing each of the water-guiding members 5 to the support member 8. Thus, the water-guiding members 5 are easily mounted to the heat exchanger 1. Further, the strength of the projecting flat surfaces 34 can be increased by mounting each of the water-guiding members 5 to the support member 8. That is, the water-guiding members 5 also serve as reinforcing members.

Other Embodiment

The present invention is not limited to the above-mentioned embodiments, and various modifications may be made to any of the embodiments without departing from the gist of the present invention. For example, in the embodiments described above, the air-conditioning apparatus 100 is given as an example of the refrigeration cycle apparatus. However, the present invention is also applicable to refrigeration cycle apparatus other than the air-conditioning apparatus 100, such as a water heater.

Further, a plurality of water-guiding members 5 may be provided in the same air gap 4. For example, in the heat exchanger 1, an amount of drainage is larger on the lower side. Consequently, a larger number of water-guiding members 5 may be arranged in the flat tube 3 that are located on the lower side.

Further, the embodiments described above may be carried out in various combinations.

The invention claimed is:

1. A heat exchanger, comprising:

a plurality of plate-like fins arranged in parallel at intervals;

a plurality of flat tubes inserted into the plurality of plate-like fins, the plurality of flat tubes being arranged in an up-and-down direction at intervals; and at least one water guide arranged between adjacent ones of the plurality of flat tubes projecting from both outermost ones of the plurality of plate-like fins and being in contact with a lower side of a projecting flat surface of an upper one of the adjacent ones of the plurality of flat tubes and an upper side of a projecting flat surface of a lower one of the adjacent ones of the plurality of flat tubes, the at least one water guide being located beyond both the outermost ones of the plurality of plate-like fins.

2. The heat exchanger of claim 1, wherein a projecting portion of each of the plurality of flat tubes is bent into a U-shape and the at least one water guide extends inside the U-shape.

3. The heat exchanger of claim 1, wherein the at least one water guide is arranged in a direction away from a center position of the projecting flat surfaces and the plurality of plate-like fins, in a longitudinal direction of the projecting flat surfaces.

4. The heat exchanger of claim 1, wherein a cross-sectional width of a contact portion of the at least one water guide in a transverse direction of the projecting flat surfaces is set to be equal to a cross-sectional width of the projecting flat surfaces in the transverse direction.

5. The heat exchanger of claim 1, wherein the at least one water guide comprises a member having a cylindrical shape, a polygonal columnar shape, or a polyhedral shape.

6. The heat exchanger of claim 1, wherein the at least one water guide comprises a member having a spherical shape.

7. The heat exchanger of claim 1, wherein the at least one water guide comprises a plurality of water guides fixed to a supporter.

8. The heat exchanger of claim 1, wherein the at least one water guide comprises a member made of the same material as materials of the plurality of flat tubes or a member made of a resin.

9. A refrigeration cycle apparatus, comprising the heat exchanger of claim 1.

* * * * *